United States Patent [19]

Buchheit

[11] 4,020,942

[45] May 3, 1977

[54] ENTRY CONVEYOR APPARATUS FOR COOLING BEDS

[76] Inventor: Otto K. Buchheit, Am Eulental 2, 667 St. Ingberg, Saar, Germany

[22] Filed: Mar. 21, 1975

[21] Appl. No.: 560,612

[30] Foreign Application Priority Data

Mar. 22, 1974 Germany ..... 2413845

[52] U.S. Cl. ..... 198/422; 198/539; 198/600; 198/773; 214/6 F

[51] Int. Cl.[2] ..... B65G 57/03

[58] Field of Search ..... 198/35, 107, 219, 422, 198/539, 600, 750, 773; 214/6 F, 6 H, 7

[56] References Cited

UNITED STATES PATENTS

| | | | |
|---|---|---|---|
| 1,536,205 | 5/1925 | George | 198/107 |
| 1,904,434 | 4/1933 | Fisk | 198/35 X |
| 2,915,204 | 12/1959 | Alimanestiano | 198/219 X |
| 3,080,069 | 3/1963 | Euwe | 214/7 X |
| 3,113,771 | 12/1963 | Tucci | 214/6 H |
| 3,265,187 | 8/1966 | Hein et al. | 198/107 |
| 3,516,221 | 6/1970 | Paxton et al. | 198/39 X |

FOREIGN PATENTS OR APPLICATIONS

| | | |
|---|---|---|
| 1,950,243 | 4/1971 | Germany |

*Primary Examiner*—Evon C. Blunk
*Assistant Examiner*—Richard K. Thomson
*Attorney, Agent, or Firm*—John J. Dennemeyer

[57] ABSTRACT

An entry roller way for conveying rolled rods and bars in particular flat or profiled rods and bars to a cooling bed has a transverse conveyor apparatus laterally connected thereto, which comprises a laterally displaceable intermediate slide member disposed between a transfer guide member and a stacking channel located adjacent the cooling bed and provided with a vertically displaceable bottom plate. The intermediate slide member is laterally displaceable in the slide plane and is provided with two comb-like edges which correspond to the comb-like edges of the adjacent transfer guide slide and the bottom plate of the stacking groove respectively; the intermediate slide member can be displaced close to the flat rods stacked on the bottom plate without interfering with the removal therefrom.

2 Claims, 3 Drawing Figures

ENTRY CONVEYOR APPARATUS FOR COOLING BEDS

This invention relates to entry conveyor apparatus for cooling beds for conveying rolled rods and bars, in particular flat and profiled rods and bars, to such cooling beds and is more particularly concerned with entry conveyor apparatus which comprises an entry roller way on which rods and bars are conveyed in the direction of their long axes and transverse conveyor means by which guide rods and bars are transferred from the roller way to the cooling bed in a direction transverse to the said long axes.

An entry roller way known from German laid-open specification No. 1,950,243 is operatively connected to a laterally displaceable intermediate slide member which is disposed between a stationary transfer guide member and a stacking channel and which has a comb-like edge construction by means of which it is in engagement with a correspondingly shaped edge of the transfer guide member.

In this known construction the mutually facing sides of the intermediate slide member and a vertically displaceable bottom plate of the stacking channel each have a rectilinear construction.

When flat rods or bars are transferred into the stacking channel and the bars have a width which has a smaller dimension than the width of the bottom plate of the stacking channel, the intermediate slide member, after lateral displacement to permit transfer, overlaps the bottom plate. It is a disadvantage in this case that the intermediate slide member must be withdrawn prior to the removal of each stack of flat rods or bars.

The invention is based on the object to find a different solution for the disposition of the intermediate slide member in which the removal of a stack of rods or bars from the stacking channel is possible without previous withdrawal of the intermediate slide member. For this purpose the invention proposes that the intermediate slide member is of comb-shaped construction also at its edge facing the stacking channel and can be moved into engagement with the oppositely disposed edge of the bottom plate of the stacking channel which edge is also of comb-like construction, wherein the uninterrupted longitudinally extending web located alongside the comb-like edge of the bottom plate of the stacking channel has a width slightly greater than that of the narrowest rods or bars to be manipulated and the intermediate slide member is laterally displaceable in such manner that its comb-like projections are controlled as close as possible to the rods or bars to be transferred without however overlapping the latter.

It is attained thereby that upon transfer of the rods from the stacking channel to the cooling bed the intermediate slide member may remain in its position selected in accordance with the width of the rods or bars without hindering the transfer process.

It is advantageous to mount the intermediate slide member for laterally reciprocatory movement on double-cranked levers and to control in this way the lateral displacement of the intermediate slide member by means of a traction rod linkage disposed in the longitudinal direction relative to the entry roller way.

One embodiment of the invention is described below by way of example with reference to the accompanying drawings, in which.

Figure 1:
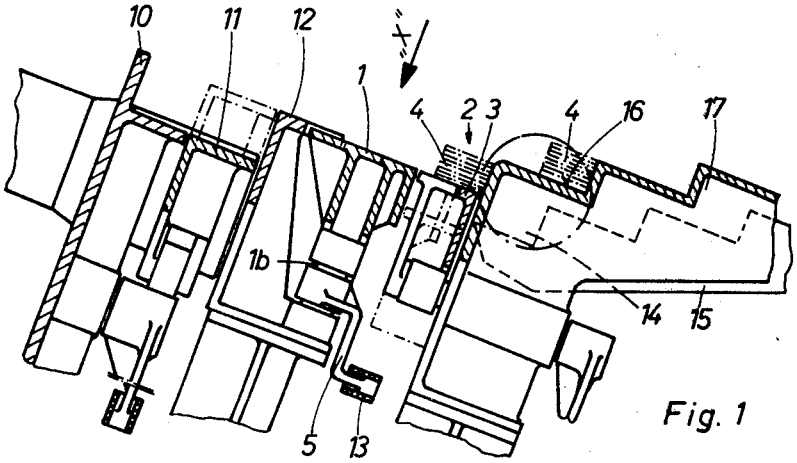
FIG. 1 illustrates a cross-section on the line I—I in FIG. 2. through the entry roller way, disposed laterally thereof, with the transfer guide member, the intermediate slide member, the stacking channel and the adjacent part of the cooling bed.

In FIG. 1, an entry roller way 10 is disposed alongside a cooling bed of which substantially only a displaceable rake member 15 and a stationary rake member 17 are shown. Between the roller way and the cooling bed and extending in the longitudinal direction of the roller way, there are disposed side-by-side in succession, a substantially vertically displaceable slide-braking member 11 adjacent the roller way, a stationary transfer guide member 12, laterally displaceable intermediate slide member 1, and a stacking channel 2 having a substantially vertically displaceable bottom plate 3 adjacent the cooling bed. The surfaces of the roller way, the slide-braking member, the stationary transfer guide member, the intermediate slide member and the bottom plate are all inclined downwardly towards the cooling bed in order that rolled rods or bars travelling on the entry roller way in the direction of their long axes can be transferred to the cooling bed in a direction transverse to the said long axes.

The stationary transfer guide member 12 has a comb-like edge which can be engaged by similar comb-like edge 1*c* of the adjacently disposed intermediate slide member 1. In the illustrated position the comb-like edge 1*c* of the intermediate slide member 1, which latter is displaceably mounted on a pivot 1*b* to permit lateral displacement of the slide member, is in maximum engagement with the comb-like edge of the stationary transfer guide member 12.

Figure 2:
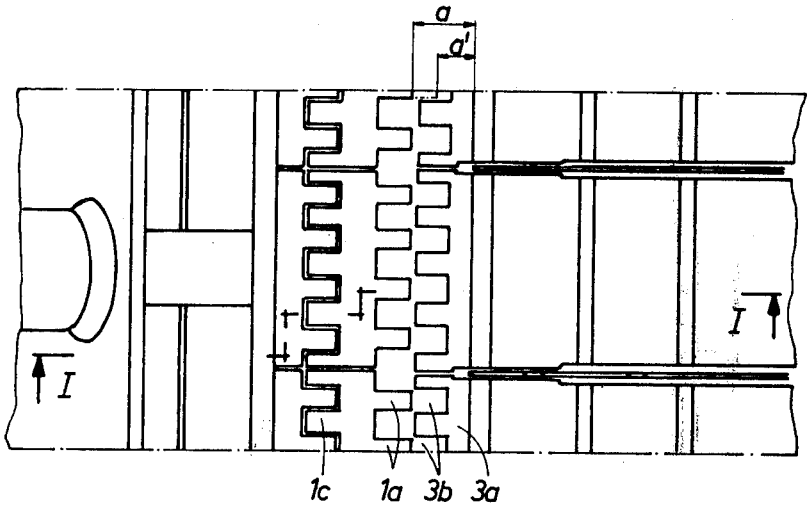
FIG. 2 illustrates a view from above of the entry roller way, the transfer guide member, the intermediate slide member, the stacking channel and the adjacent part of the cooling bed.

The other edge 1*a* of the intermediate slide member 1 is also of comb-like construction and is adapted to mesh with the adjacent comb-like edge 3*b* of the bottom plate 3 In the position illustrated in FIG. 2. adjacent edges of the intermediate slide member 1 and the transfer guide member 12 are substantially fully enmeshed one with the other, the intermediate slide member 1 being laterally displaced away from the stacking channel 2 by a distance *a*.

In this position of the intermediate slide member 1 the dimension *a* permits the stacking of rods or bars of a miximum width in the stacking channel 2.

During a stacking process of flat rods or bars the bottom plate 3 of the stacking channel is lowered step-by-step in accordance with the thickness of each flat rod or bar to be stacked to form a stack 4 in such manner that a respective next following flat rod or bar can slide sideways without shock into the stacking channel and on top of a rod or bar previously delivered thereto. After a predetermined height of the stack 4 has been attained, the bottom plate 3 is returned to its starting position flush with the level of the intermediate slide member 1. The stack 4 is transferred by means of a first notch 14 of the displaceable cooling bed rake member 15 into a first notch 16 of the stationary cooling bed rake member 17. Alternatively, and depending upon the rolling programme, each transversely conveyed flat rod or bar can be transferred singly.

Figure 3:
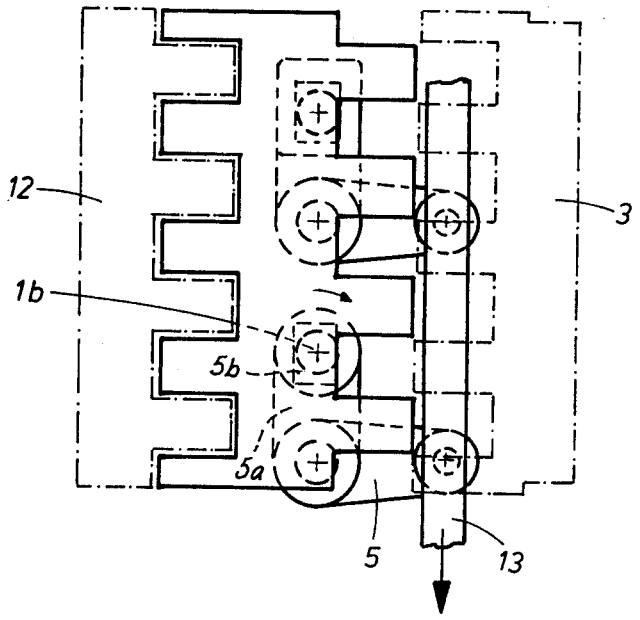
FIG. 3 is a partial view from above of the intermediate slide member in the direction of arrow X in FIG. 1, on an enlarged scale.

When stacking flat rods or bars of smaller than maximum width, the intermediate slide member 1 is displaced in the direction of the stacking channel 2 by means of a traction rod linkage 13 actuating double cranked levers 5 as shown more clearly in FIG. 3. The spacing *a* in FIG. 2 may be reduced to a spacing *a'* so selected in this case that it is slightly greater than the width of the respective flat rod or bar. In this case the comb-like edge 1*a* of the intermediate slide member 1 is in meshing engagement with the similarly comb-like edge 3*b* of the bottom plate 3.

After the stacking process has been finished, the bottom plate 3 of the stacking channel 2 is moved upwards into its starting position and the stack is transferred in the manner described already above. The intermediate slide member 1 remains in this case in its adjusted displaced position and does not interfere with the transfer process of the stack to the cooling bed.

When the flat rods or bars have a width of approximately equal to that of the uninterrupted web member 3*a* of the bottom plate 3 of the stacking channel 2, the comb-like edges 1*a* and 3*b* inter-engage to a maximum extent, without interrupting thereby the continuous transfer from the transfer guide member 12 to the intermediate slide member 1, as the respective edges thereof remain enmeshed to some extent.

It is understood that an elongated hole connection is required between the dobule cranked levers 5 and the attachment thereof at the intermediate slide member 1 because the intermediate slide member 1, when performing the lateral displacement, is guided rectilinearly by the respective mutually interengaging comb-like edge structures.

This is more clearly seen in FIG. 3 wherein slide member 1 is mounted on a plurality of vertically extending pivot pins 1*b* secured to arms 5*a* of a plurality of cranked levers 5. Levers 5 are commonly actuated by a traction rod 13 disposed parallel to the longitudinal axis of entry rollerway 10. Elongated holes 5*b* are provided in arms 5*a* to permit free play between pivot pins 1*b* and their corresponding arms 5*a*.

What is claimed is:

1. In a transverse conveyor for transferring flat stock articles from an entry rollerway to a cooling bed wherein the conveyor is defined by a declined transfer surface that includes a stationary guide having a first comb-like edge, a vertically displaceable bottom plate for accumulating a stack of the flat stock articles, and a laterally displaceable slide member disposed between the stationary guide and the bottom plate, which slide member is provided with a second comb-like edge for intermeshing engagement with the first comb-like edge, the improvement comprising:

a. a third comb-like edge on the slide member disposed parallel to and directed away from the second comb-like edge, b. a fourth comb-like edge on the vertically displaceable bottom plate disposed parallel to and directed towards the third comb-like edge such that lateral displacement of the slide member causes the third and fourth comb-like edges to variably intermesh with each other in accordance with the width of the flat stock articles being transferred and thereby permit the bottom plate to accumulate and vertically displace a stack of the flat stock articles without requiring lateral displacement of the slide member towards the stationary guide, c. a plurality of double cranked levers actuated by a traction rod linkage disposed parallel to the longitudinal axis of the entry rollerway for laterally displacing the slide member, and d. a plurality of vertically extending pivot pins carried by corresponding arms provided on the double cranked levers for supporting the slide member, wherein elongated holes are provided in the arms for permitting free play between the pins and their corresponding arms when the slide member is laterally displaced.

2. The transverse conveyor of claim 1 wherein the vertically displaceable bottom plate further includes a section of continuous and uninterrupted support surface adjacent and parallel to the second comb-like edge for supporting articles having a width that is narrower than the width of the support surface.

* * * * *

UNITED STATES PATENT OFFICE

CERTIFICATE OF CORRECTION

Patent No. 4,020,942 Dated May 3, 1977

Inventor(s) OTTO K. BUCHHEIT

It is certified that error appears in the above-identified patent and that said Letters Patent are hereby corrected as shown below:

The assignee should appear as:

Moeller & Neumann GmbH
Germany

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*